US009599348B2

(12) United States Patent
Choi et al.

(10) Patent No.: US 9,599,348 B2
(45) Date of Patent: Mar. 21, 2017

(54) COOKTOP WITH DEFORMABLE HOOK

(75) Inventors: Byoungwoo Choi, Changwon (KR); Euisu Jung, Changwon (KR); Jungmin Cha, Changwon (KR)

(73) Assignee: LG ELECTRONICS INC., Seoul (KR)

( * ) Notice: Subject to any disclaimer, the term of this patent is extended or adjusted under 35 U.S.C. 154(b) by 1280 days.

(21) Appl. No.: 13/553,687

(22) Filed: Jul. 19, 2012

(65) Prior Publication Data

US 2013/0019851 A1 Jan. 24, 2013

(30) Foreign Application Priority Data

Jul. 21, 2011 (KR) ..... 10-2011-0072666

(51) Int. Cl.
*F24C 15/00* (2006.01)
*F24C 15/10* (2006.01)

(52) U.S. Cl.
CPC ..... *F24C 15/00* (2013.01); *F24C 15/108* (2013.01)

(58) Field of Classification Search
CPC ..... F24C 15/108
USPC ..... 126/19 R, 50, 211, 214 A
See application file for complete search history.

(56) References Cited

U.S. PATENT DOCUMENTS 2,994,317 A * 8/1961 More ..... F24C 15/108 126/211
3,090,587 A * 5/1963 Peterson ..... A47B 77/08 248/27.1
3,392,720 A * 7/1968 Sherman ..... A47B 77/08 126/211
3,412,727 A * 11/1968 Hurko ..... F24C 15/108 126/211
3,446,201 A * 5/1969 More ..... A47B 77/08 126/39 H
3,561,020 A * 2/1971 Fritzsche ..... F24C 15/108 126/211
3,612,829 A * 10/1971 Evans ..... F24C 15/108 219/452.12
3,613,177 A * 10/1971 Davis ..... F24C 15/108 219/452.11
3,632,983 A * 1/1972 Dills ..... H05B 3/748 126/39 J
3,674,983 A * 7/1972 Hurko ..... F24C 15/108 219/436
3,701,171 A * 10/1972 Fritzsche ..... A47B 77/08 126/214 A (Continued)

FOREIGN PATENT DOCUMENTS

KR 10-2006-0014789 A 2/2006
KR 10-0771628 B1 10/2007

*Primary Examiner* — Avinash Savani
*Assistant Examiner* — Aaron Heyamoto
(74) *Attorney, Agent, or Firm* — Birch, Stewart, Kolasch & Birch, LLP

(57) ABSTRACT

An oven having a cabinet and a cooktop disposed above the cabinet is provided. The cooktop includes a top frame located at a top surface of the cabinet, the top frame including at least one heater installation opening and at least two heater support brackets adjacent the installation opening, a top plate located on a top surface of the top frame, and a heater located in the installation opening, the heater including at least two heater support holders, each support holder being elastically coupled to a corresponding support bracket to movably support the heater.

17 Claims, 7 Drawing Sheets

(56) References Cited

U.S. PATENT DOCUMENTS

| | | | | |
|---|---|---|---|---|
| 6,410,892 | B1 * | 6/2002 | Peschl | F24C 15/102<br>126/218 |
| 2007/0044788 | A1 * | 3/2007 | Jacobs | F24C 15/108<br>126/211 |
| 2014/0263276 | A1 * | 9/2014 | Harward | F24C 15/108<br>219/454.12 |

* cited by examiner

COOKTOP WITH DEFORMABLE HOOK

CROSS-REFERENCE TO RELATED APPLICATIONS

This application is claims the benefit of priority to Korean Application No. 10-2011-0072666, filed on Jul. 21, 2011, which is herein incorporated by reference in its entirety.

BACKGROUND

Field of the Disclosure

The present disclosure relates generally to an oven and, more particularly, to an oven having a cooktop.

Description of Related Art

Ovens, whether electric or gas, are home appliances used for heating foods. A cooktop is typically disposed on a top surface of such an oven. The cooktop includes a top frame, a top plate for covering a top surface of the top fame, and a plurality of cooktop heaters for heating a container containing foods seated on the top plate. Each of the cooktop heaters may be classified into an induction heater and a radiant heater according to its heating type. Also, the cooktop heater may be classified as a cooking heater and a warming heater according to its output power.

Generally, the cooktop heater is elastically supported by the top plate through a separate bracket. For example, the cooktop heater is elastically supported by a bracket disposed on the top plate. The bracket is fixed to the top frame is movable in a state where the cooktop heater is disposed at a predetermined position with respect to the top frame prior to fixing the cooktop heater to the top frame. Thus, since the moving of the cooktop heater and the supporting of the cooktop heater through the bracket are separately performed, it may be inconvenient to perform the process for supporting the cooktop heater on the top frame.

BRIEF SUMMARY OF THE DISCLOSURE

Exemplary embodiments of an oven are provided, where the oven is configured to easily support a cooktop heater on a top frame.

In one exemplary embodiment, an oven includes a cabinet and a cooktop disposed above the cabinet. The cooktop includes a top frame located at a top surface of the cabinet, the top frame including at least one heater installation opening and at least two heater support brackets adjacent the installation opening, a top plate located on a top surface of the top frame, and a heater located in the installation opening, the heater including at least two heater support holders, each support holder being elastically coupled to a corresponding support bracket to movably support the heater.

In another exemplary embodiment, an oven includes a cabinet and a cooktop disposed above the cabinet where the cooktop includes a top frame located at a top surface of the cabinet, the top frame including a plurality of heater installation openings and at least two heater support brackets adjacent each of the installation openings, a top plate located on a top surface of the top frame, and a plurality of heaters, each heater located in a corresponding installation opening, each heater including at least two heater support holders, each of the support holders being elastically coupled to corresponding support brackets to movably support the heater.

Further scope of applicability of the present disclosure will become more apparent from the detailed description given hereinafter. However, it should be understood that the detailed description and specific examples, while indicating various exemplary embodiments of the disclosure, are given by way of illustration only, since various changes and modifications within the spirit and scope of the disclosure will become apparent to those skilled in the art from the detailed description.

BRIEF DESCRIPTION OF THE DRAWINGS

The present disclosure will become more fully understood from the detailed description given hereinbelow and the accompanying drawings which are given by way of illustration only, and thus are not limitative of the present disclosure and wherein.

DETAILED DESCRIPTION OF THE DISCLOSURE

Hereinafter, an oven according to exemplary embodiments will be described in detail with reference to the accompanying drawings.

Figure 1:
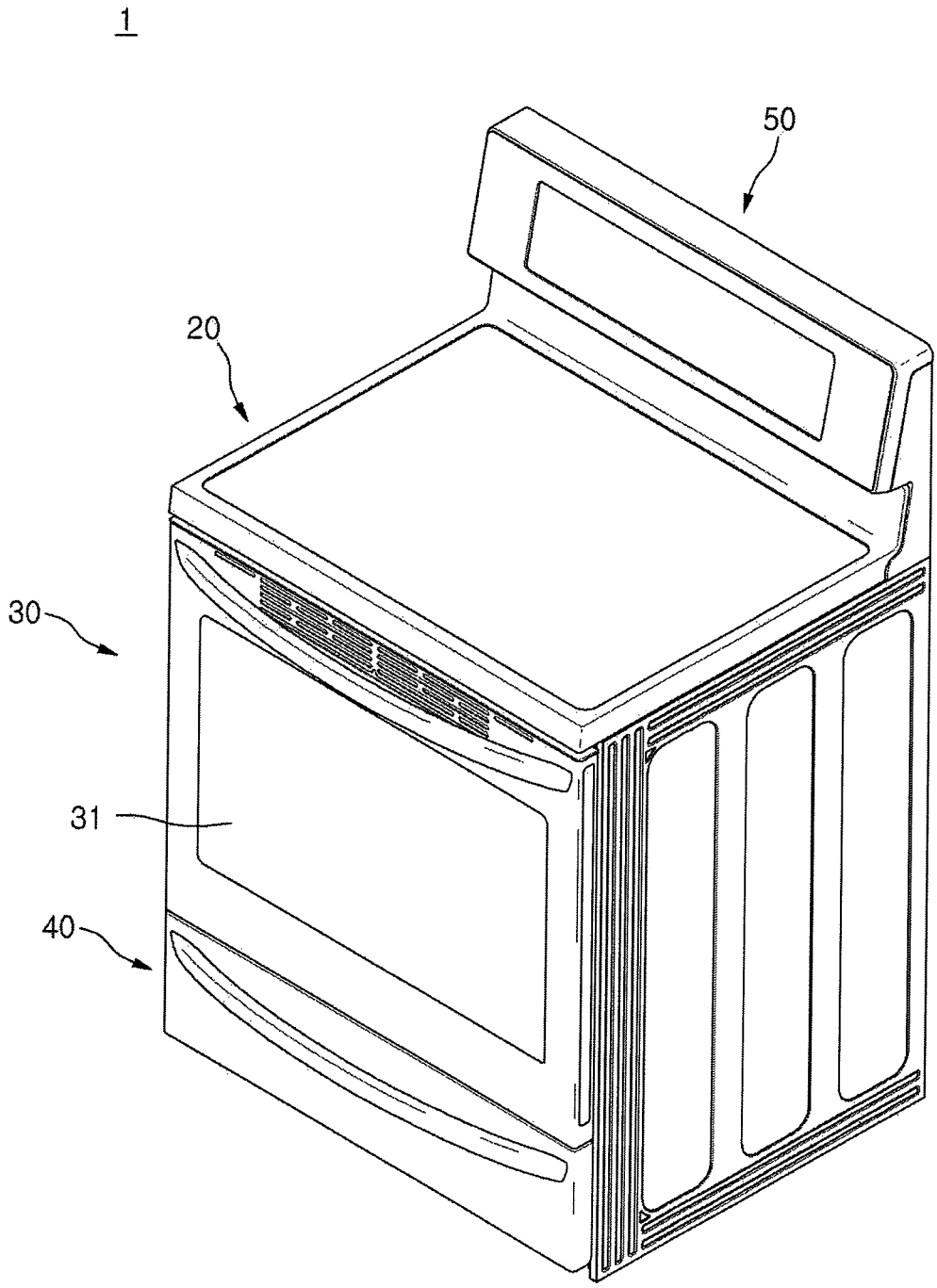
FIG. 1 is a perspective view of an oven according to a first exemplary embodiment.

Referring to FIG. 1, a cooktop 20 is disposed above a cabinet 10 of an oven range. The cooktop 20 heats a container containing a food on a top surface thereof. A detailed structure of the cooktop 20 will be described below.

An oven unit 30 is disposed inside the cabinet 10 under the cooktop 20. The oven unit 30 has an oven compartment (not shown) for cooking the food. The oven compartment is selectively opened by an oven door 31. A heating source for heating the food, for example, a broil heater, a bake heater, or a convection device is disposed inside the oven compartment.

A drawer unit 40 is disposed at a lower side of the cabinet 10 under the oven unit 30. The drawer unit 40 may thermally insulate the food or the container containing the food from the outside.

A control panel 50 is disposed on a rear end of a top surface of the cabinet 10 corresponding to a rear side of the cooktop 20. The control panel 50 receives signal for operating the cooktop 20, the oven unit 30, and the drawer unit 40. Also, the control panel 50 displays information with respect to the operations of the cooktop 20, the oven unit 30, and the drawer unit 40.

Figure 2:
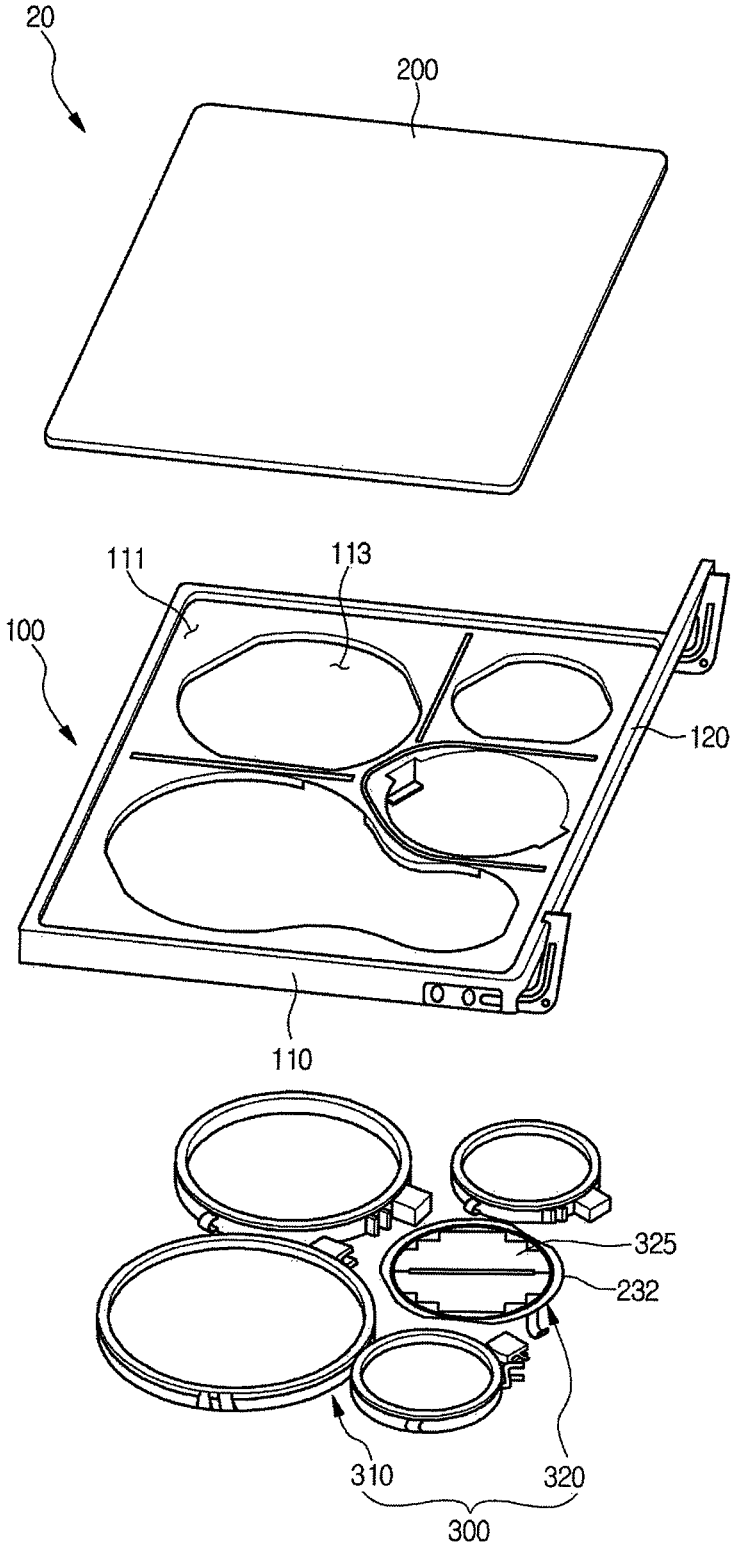
FIG. 2 is exploded perspective view of a cooktop according to the first exemplary embodiment.

Referring to FIG. 2, the cooktop 20 includes a top frame 100, a top plate 200, and a plurality of cooktop heaters 300. In this exemplary embodiment, the top frame 100 is fixed to the top surface of the cabinet 10. The top plate 200 is seated on a top surface of the top frame 100. Each of the cooktop heaters 300 is supported by the top frame 100.

In more detail, the top frame 100 includes a top surface 110 and a rear surface 120. The top surface 110 has an approximately rectangular plate shape. The rear surface 120 extends inclinedly upward and backward at a right angle or predetermined angle from a rear end of the top surface 110. According to this exemplary embodiment, the top surface 110 and the rear surface 120 are formed in one body. Also, the rear surface 120 may define a portion of a front surface of the control panel 50.

A plate seat groove 111 is defined in the top surface 110. The remaining portion of the top surface 110, except a circumference portion of the top surface 110, may be stepped downward to define the plate seat groove 111. The top plate 200 is seated on the plate seat groove 111.

A plurality of heater installation openings 113 are defined in the top surface 110. Each of the cooktop heaters 300 is disposed in a corresponding heater installation opening 113. As a result, the cooktop heaters 300 may contact or be disposed adjacent to a bottom surface of the top plate 200 while located in the heater installation openings 113.

The top plate 200 may transmit heat generated in any of the cooktop heaters 300 into the container containing the food on the top surface disposed above the cooktop heater 300. The top plate 200 may be formed of ceramic glass or other suitable material that allows for heat transfer to the container on the top surface of the top plate 200.

The cooktop heaters 300 provide heat for heating the container in which the food is seated on the top surface of the top plate 200. In the current exemplary embodiment, the cooktop heaters 300 include four cooking heaters 310 providing heat for cooking the food and one warming heater 320 providing heat for heating the food. However, the above-described structure of the cooktop heaters 300 are illustrated as an example. The present disclosure is not limited to the shown structure of the cooktop heaters 300.

The cooktop heaters 300 are supported by the top frame 100. Hereinafter, a structure in which the warming heater 320 of the cooktop heaters 300 is supported by the top frame 100 will be described in detail. Each of the cooking heaters 310, the cooking heater 310 may be supported by the top fame 100 using the same structure and, therefore, separate description thereof will be eliminated.

Figure 3:
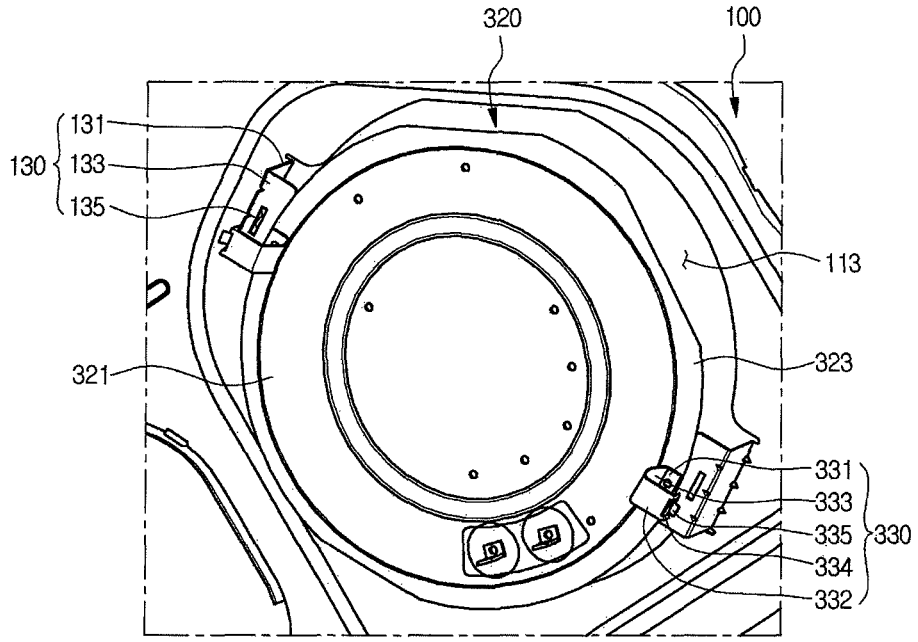
FIG. 3 is partial perspective view illustrating a main part of the cooktop according to the first exemplary embodiment.
Figure 4:
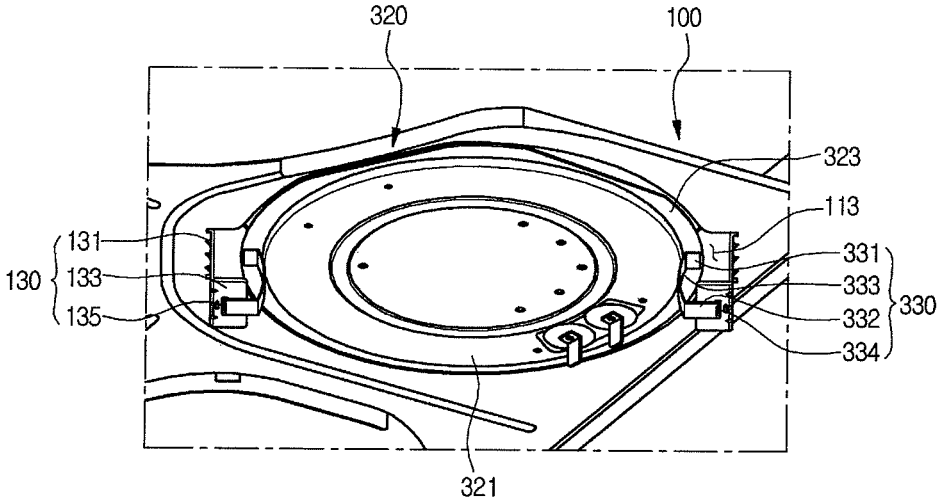
FIG. 4 is a partial perspective view illustrating the main part of the cooktop according to the first exemplary embodiment.

Referring to FIGS. 3 and 4, a plurality of heater support brackets 130 are disposed on the top frame 100. Although two heater support brackets 130 are illustrated in FIGS. 3 and 4, the present disclosure is not limited to this number of heater support brackets 130. For example, three or more heater support brackets 130 may be provided. Each of the heater support brackets 130 is disposed at a side of the top frame 100 adjacent to the heater installation opening 113. The heater support bracket 130 includes an extension part 131 and a support part 133. According to this exemplary embodiment, a portion of the top frame 100 may be cut and bent to form the heater support bracket 130; however, a heater support bracket 130 may be provided as a separate component.

The extension part 131 extends downward from a side of the top frame 100 adjacent to the heater installation opening 113. The support part 133 extends at a predetermined angle with respect to the extension part 131 from a lower end of the extension part 131. For example, the support part 133 may extend perpendicular to the extension part 131. Here, the support part 133 extends toward the inside of the heater installation opening 113 from the lower end of the extension part 131. As a result, the support part 133 may be positioned in the heater installation opening 113. An insertion slot 135 is provided in the support part 133, for example, a portion of the support part 133 may be cut to form the insertion slot 135.

The warming heater 320 includes a heater base 321 and a heat generation part 325 (shown in FIG. 2). The heater base 321 has a polyhedron shape having a section corresponding to that of the heater installation opening 113, for example, a flat cylindrical shape. The heat generation part 325 is disposed inside the heater base 321. A coil heater or a plate-shaped heater, which has a predetermined resistance, may be used as the heat generation part 325, but the heat generation part 325 is not so limited.

A flange 323 is disposed on an upper end of the heater base 321. The flange 323 radially extends from the upper end of the heater base 321. A plurality of heater support holders 330 is disposed on the flange 323.

The heater support holders 330 are elastically coupled to the heater support bracket 130 to allow the warming heater 320 to be supported by the top frame 100. Each of the heater support holders is formed of a material having a predetermined elasticity. In more detail, the heater support holder 330 includes a fixing part 331, a contact part 332, a connection part 333, an insertion part 334, and a hook part 335.

The fixing part 331 is fixed to a bottom surface of the flange 323. For example, the fixing part 331 may be welded to the bottom surface of the flange 323 in a state where the fixing part 331 contacts the bottom surface of the flange 323.

As shown, the contact part 332 may be disposed under the fixing part 331. A top surface of the contact part 332 contacts a top surface of the support part 133 when the heater support holder 330 is coupled to the heater support bracket 130. Here, at least one portion of the contact part 332 is disposed outside the heater base 321.

The connection part 333 connects the fixing part 331 to the contact part 332. The connection part 333 has predetermined elasticity to elastically support the warming heater 320 with respect to the top fame 100. For example, the connection part 333 may be rounded with a predetermined curvature so that it 333 is elastically deformed against an external force.

The insertion part 334 extends at a predetermined angle from the other end of the contact part 332. For example, the insertion part 334 may extend upward perpendicular to the contact part 332 from the other end of the contact part 332. Also, the insertion part 334 is inserted into the insertion slot 135 when the contact part 332 contacts the support part 133.

Also, the hook part 335 may prevent the insertion part 334 from being randomly separated from the insertion slot 135 in a state where the insertion part 334 is inserted into the insertion slot 135. For example, a portion of the insertion part 334 may be cut and then bent with respect to the insertion part 334 to form the hook part 335. Here, a front end of the hook part 335 is disposed outside the insertion part 334. Also, the hook part 335 is elastically deformed with respect to the insertion part 334 to prevent the insertion part 334 from interfering with the insertion slot 135 in the process in which the insertion part 334 is inserted into the insertion slot 135. However, the hook part 335 returns to its original position due to the elasticity and is hooked on a side of the contact part 332 when the insertion part 334 is completely inserted into the insertion slot 135. Thus, the insertion part 334 is not randomly separated from the insertion slot 135 in the state where the insertion part 334 is inserted into the insertion slot 135.

Hereinafter, a process of installing the cooktop heater according to the first exemplary embodiment will be described in detail with reference to the FIGS. 5 and 6.

Figure 5:
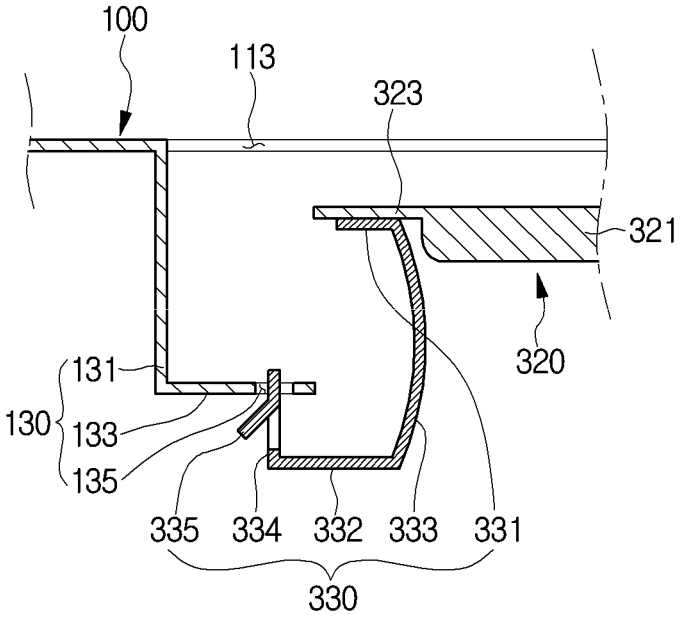
FIGS. 5 and 6 are views illustrating a process of installing a cooktop heater in the oven according to the first exemplary embodiment.

Referring to FIG. 5, an insertion part 334 is inserted into an insertion slot 135 when a warming heater 320 to which a heater support holder 330 is fixed is moved toward a heater installation opening 113. Then, when the warning heater 320 is continuously moved, the insertion part 334 is continuously inserted into the insertion slot 135. Here, a hook part 335 may be elastically deformed when the insertion part 334 is inserted into the insertion slot 135. Thus, the insertion part 334 does not interfere with the insertion slot 135.

Figure 6:
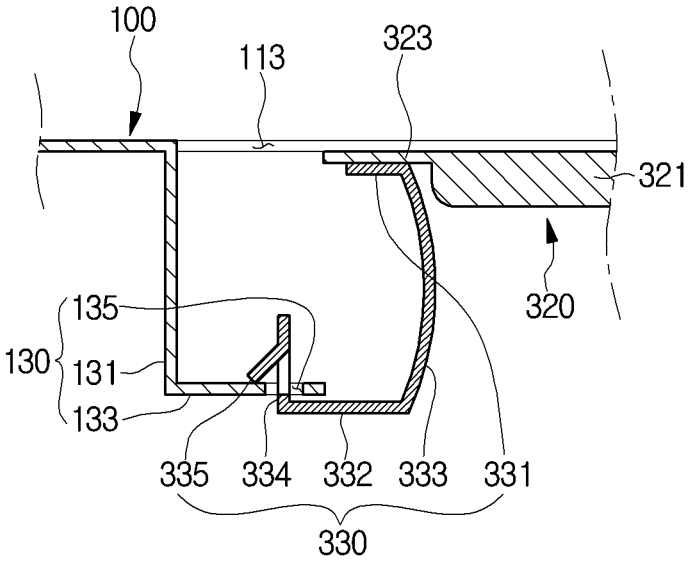

Referring to FIG. 6, when the insertion part 334 is completely inserted into the insertion slot 135, the hook part 335 is elastically deformed to return to an original position thereof. Thus, since the front end of the hook part 335 is hooked on a side of the support part 133, the insertion part 334 is not randomly separated from the insertion slot 135. According to this exemplary embodiment, since the heater support holder 330 is maintained in a state where it 330 is coupled to a heater support bracket 130, the warming heater 320 is supported by a top frame 100.

As described above, the warming heater 320 may be moved once to couple the heater support holder 330 to the heater support bracket 130. Thus, in the current exemplary embodiment, the warming heater 320 may be further easily supported by the top frame 100.

Also, after the hook part 335 is elastically deformed with respect to the insertion part 334, when the insertion part 334 is separated from the insertion slot 135, the separation of the heater support bracket 130 and the heater support holder 330 may be completed. Thus, to repair or replace the oven, the warming heater 320 may be easily separated from the top plate 200.

Hereinafter, an oven according to a second exemplary embodiment will be described in detail with reference to FIG. 7.

Figure 7:
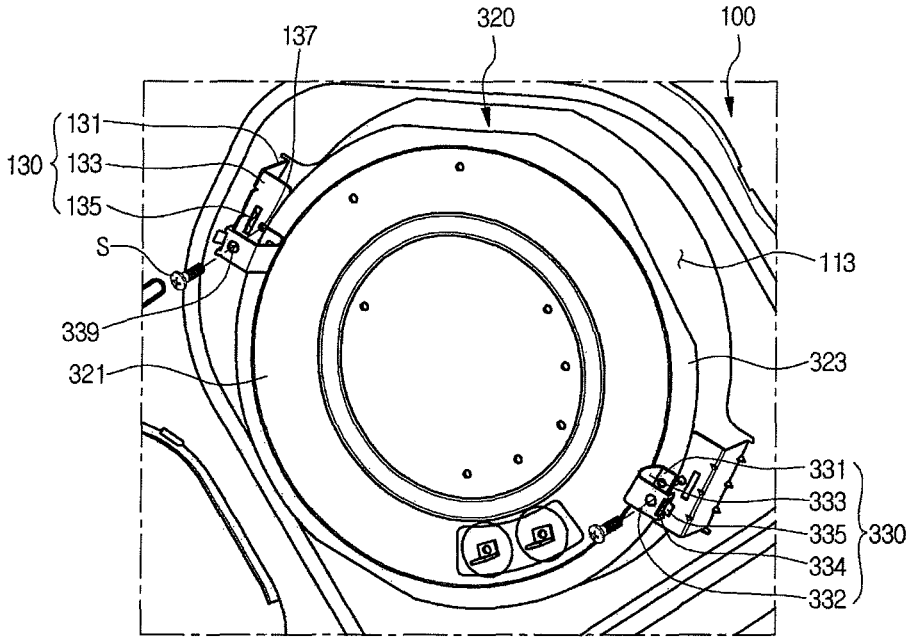
FIG. 7 is a partial perspective view illustrating a main part of a cooktop according to a second exemplary embodiment.

Referring to FIG. 7, in the current exemplary embodiment, a heater support bracket 130 and a heater support holder 330 are fixed by a coupling unit S in a state where the heater support bracket 130 and the heater support holder 330 are elastically coupled to each other. Thus, the heater support bracket 130 and the heater support holder 330 may be further firmly fixed.

A coupling hole 137 is provided in the heater support bracket 130, for example, in the support part 133. The coupling hole 137 is defined in a position relatively adjacent to a front end of the support part 133 when compared to that of an insertion slot 135. Also, a through-hole 339 is provided in the heater support holder 330, for example, in the contact part 332. Thus, since the coupling unit S passes through the through-hole 339 and is coupled to the coupling hole 137 in a state where an insertion part 334 is completely inserted into the insertion slot 135, the heater support bracket 130 and the heater support holder 330 may be further firmly fixed.

Although the heater support holder is fixed to the heater base in the above-described exemplary embodiment, the heater support holder may be integrated with the heater base.

Also, in the above-described exemplary embodiment, the insertion slot and the insertion part are defined or disposed in/on the heater support bracket and the heater support holder, respectively. However, the insertion slot may be provided in the heater support holder, and the insertion part may be disposed on the heater support bracket.

According to the oven according to the exemplary embodiments, it may be expected that the cooktop heater may be more simply and firmly fixed.

Although exemplary embodiments have been described with reference to a number of illustrative exemplary embodiments thereof, it should be understood that numerous other modifications and exemplary embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An oven comprising:

a cabinet; and a cooktop disposed above the cabinet, the cooktop including:

a top frame located at a top surface of the cabinet, the top frame including at least one heater installation opening and at least two heater support brackets adjacent the installation opening;

a top plate located on a top surface of the top frame; and a heater located in the installation opening, the heater including at least two heater support holders, each heater support holder being elastically coupled to a corresponding heater support bracket to movably support the heater, wherein each heater support holder comprises an insertion part with a hook part, wherein each heater support bracket comprises an extension part extending downward from a side of the top frame, and a support part extending perpendicularly with respect to the extension part and having an insertion slot, and wherein the insertion part upwardly passes through the insertion slot at a lower side of the extension part.

2. The oven according to claim 1, wherein each heater support bracket is integrally formed with the top frame.

3. The oven according to claim 1, wherein the hook part is hooked on a side of the heater support bracket when the insertion part is inserted into the insertion slot.

4. The oven according to claim 3, wherein the hook part is elastically deformed when the insertion part is inserted into the insertion slot.

5. The oven according to claim 1, wherein at least a portion of each of the heater support holders is rounded with a preset curvature.

6. The oven according to claim 1, wherein each heater support holder further includes:

a fixing part fixed to a side of the cooktop heater;

a contact part disposed under the fixing part; and a connection part connecting the fixing part to the contact part, and wherein the insertion part is extended from a side of the connection part.

7. The oven according to claim 6, wherein the connection part is rounded with a preset curvature.

8. The oven according to claim 6, wherein the hook part is elastically deformed when the insertion part is inserted into the insertion slot.

9. The oven according to claim 1, wherein each of the heater support brackets and heater support holders are elastically coupled to each other and fixed by a coupling unit.

10. An oven comprising:

a cabinet; and a cooktop disposed above the cabinet, the cooktop including:

a top frame located at a top surface of the cabinet, the top frame including a plurality of heater installation openings and at least two heater support brackets adjacent each of the installation openings;

a top plate located on a top surface of the top frame; and a plurality of heaters, each heater located in a corresponding heater installation opening, each heater including at least two heater support holders, each of the heater support holders being elastically coupled to corresponding heater support brackets to movably support the heater, wherein each of the heater support holders comprises an insertion part with a hook part, wherein each of the heater support brackets comprises an extension part extending downward from a side of the top frame, and a support part extending perpendicularly with respect to the extension part and having an insertion slot, and wherein the insertion part upwardly passes through the insertion slot at a lower side of the extension part.

11. The oven according to claim 10, wherein the extension part extends perpendicular to the top frame.

12. The oven according to claim 11, wherein at least a portion of each of the heater support brackets is positioned in a corresponding heater installation opening.

13. The oven according to claim 10, wherein each of the plurality of heaters includes:

a heater base on which the heater support holders are disposed; and a heat generation unit disposed on a top surface of the heater base.

14. The oven according to claim 13, wherein each of the heater support holders is welded to a flange of the heater base.

15. The oven according to claim 10, wherein at least a portion of each of the heater support holders is rounded with a preset curvature to elastically support the heater on the top frame.

16. The oven according to claim 10, wherein each of the heater support holders includes:

a fixing part fixed to one heater of the plurality of heaters;

a contact part in which at least portion thereof is disposed outside said one heater, the contact part being disposed under the fixing part;

a connection part connecting the fixing part to the contact part, and wherein the hook part is bent with respect to the insertion part after a portion of the insertion part is cut, the hook part being elastically deformable with respect to the insertion part when the insertion part is inserted into the insertion slot so as to return to an initial position thereof when the insertion part is completely inserted into the insertion slot.

17. The oven according to claim 10, wherein a coupling hole is provided in each of the heater support brackets, a through-hole is provided in each of the heater support holders, and a coupling unit passes through the through-hole and is coupled to the coupling hole.

* * * * *